US006098961A

United States Patent [19]

Gionet

[11] Patent Number: 6,098,961

[45] Date of Patent: Aug. 8, 2000

[54] SINGLE-WHEEL HYDRAULIC JACK

[76] Inventor: Roger Gionet, 208 Marshall Hill Rd., Wards Creek, New Brunswick, Canada, E4E 4M7

[21] Appl. No.: 09/358,403

[22] Filed: Jul. 22, 1999

[51] Int. Cl.[7] ..... B66F 3/22

[52] U.S. Cl. ..... 254/122

[58] Field of Search ..... 254/88, 90, 94, 254/122, 124, 126, 3 R, 3 B, 3 C, 5 R, 5 B, 5 C, DIG. 4, DIG. 1, 8 R, 8 B, 8 C, 9 R, 9 B, 96

[56] References Cited

U.S. PATENT DOCUMENTS

| | | | |
|---|---|---|---|
| 2,937,003 | 5/1960 | Croll | 254/122 |
| 3,292,902 | 12/1966 | Lynch . | |
| 3,784,161 | 1/1974 | Frese . | |
| 4,251,056 | 2/1981 | Maniglia | 254/8 B |
| 5,215,287 | 6/1993 | Leski | 254/122 |
| 5,503,368 | 4/1996 | Torres . | |

*Primary Examiner*—Robert C. Watson
*Attorney, Agent, or Firm*—Mario D. Theriault

[57] ABSTRACT

There is provided a jack for raising a wheel of a vehicle and comprising a horizontal base having spaced-apart front end and entry end, and spaced-apart side members extending between the front end and the entry end. A scissors-like lifting mechanism is connected to the horizontal base and has an upper end movable between a raised position at a distance above the horizontal base and a collapsed position near the horizontal base. A force-applying actuator is connected to the horizontal base and to the scissors-like lifting mechanism for actuating the scissors-like lifting mechanism. A wheel tray is connected to the upper end of the scissors-like lifting mechanism for up and down movement thereof between the raised position and the collapsed position. The wheel tray has spaced-apart front portion and entry portion, a bottom surface and a bumper on the front portion. A crossbar is mounted in the scissors-like lifting mechanism for engaging with the wheel tray and for causing the entry portion of the wheel tray to lean down relative to the front portion when the upper end of the scissors-like lifting mechanism is in the collapsed position. The connections of the scissors-like lifting mechanism with the front portion of the wheel tray are differing in height and engagement sequence with the connections to the entry portion for causing the front portion of the wheel tray to lean down relative to the entry portion when the upper end of the scissors-like lifting mechanism is in the raised position.

20 Claims, 4 Drawing Sheets

SINGLE-WHEEL HYDRAULIC JACK

FIELD OF THE INVENTION

The present invention relates to vehicle jacks and more particularly it pertains to a single-wheel hydraulic jack having a wheel tray that is inclinable in a first direction for facilitating the rolling of a wheel therein, and in a second direction for preventing a wheel from rolling off the jack during the lifting of a vehicle with the jack.

BACKGROUND OF THE INVENTION

Vehicle jacks are used in garages and body repair shops for examples, for lifting one or more wheels of a vehicle off the ground for carrying out repair or maintenance work on the vehicle. Vehicle jacks are sometime used by apprentices and inadvertent vehicle owners having more or less appreciation for the risks associated with the lifting of a vehicle and working under it. Conventional bumper jacks, axle jacks and scissors-type chassis jacks for examples are known to be unstable in certain circumstances and are generally not recommended for use without additional safety blocking. In that regard, clear written safety instructions are normally provided with the purchase of every vehicle jack. However, because of the inexperience of some users of vehicle jacks, and for other various reasons, proper vehicle lifting instructions are not always followed and users of vehicle jacks continue to be exposed to serious accidents.

In regard to improving the safety of vehicle jacks, a number of single-wheel jacks have been developed in the past. Some of these single-wheel jacks have a wheel tray for receiving a vehicle wheel and a broad base to prevent tilting of the jack when used on soft or uneven ground for example. Three models of single-wheel jacks of the prior art are described and illustrated in the following documents for reference purposes:

U.S. Pat. No. 3,292,902 issued on Dec. 20, 1966 to M. F. Lynch. The portable tire lift illustrated therein has a broad base, a lifting plate, a wheel tray mounted to the lifting plate and a scissors-type lifting mechanism connected to the broad base and to the lifting plate. A support post is mounted to the base and is engaged into a portion of the lifting plate. The post has vertically spaced-apart ridges for supporting the lifting plate and for preventing accidental collapsing of the lifting plate.

U.S. Pat. No. 3,784,161 issued on Jan. 8, 1974 to R. L. Frese. The wheel removal safety device illustrated therein is used for assisting in positioning a flat tire wheel at a certain height such that an axle jack or a bumper jack may be installed for removing and replacing the wheel. The device has a tilting plate forming an inclined surface on which the wheel is driven. The plate has a fulcrum at its centre point and is adapted to tilt and form an elevated horizontal surface when a wheel is driven thereon and moves pass the fulcrum. A conventional jack is then easily introduced under the elevated axle or bumper.

U.S. Pat. No. 5,503,368 issued on Apr. 2, 1996 to Manuel Torres. This patent describes a scissors-type wheel lift having broad base, a wheel tray and a scissors-type lifting mechanism connected to the wheel tray and to the broad base, for lifting the wheel tray. The wheel lift is used in combination with a ramp having a height corresponding to the height of the wheel tray when the wheel tray is in a collapsed mode. In use, a wheel is driven over the ramp and into a wheel tray. A hand crank and a screw are used to operate the scissors-type lifting mechanism.

It has been found that a common problem with the lifting of a vehicle with a jack is that a partial raising of a vehicle, on one corner or on one end of the vehicle, causes the whole vehicle to be pulled toward the jack. Therefore, when the wheel being lifted is not properly retained inside the wheel tray of a jack, or when one of the supporting wheels is chocked against the jack, the wheel being lifted tends to roll out of the wheel tray, thereby causing a hazardous condition.

Another problem with scissors-type lifting mechanisms of single-wheel jacks of the prior art is that the mechanism has a substantial vertical thickness. Modern compact vehicle have relatively small diameter wheels, of 14 and 15 inches for examples. These wheels are often too small to afford a smooth rolling over the scissors-type lifting mechanism and into the wheel tray of these vehicle jacks.

It is believed that these problems basically, have contributed to cause significant obstacles to the commercial success of the wheel-tray-type jacks of the prior art. It is further believed that there continues to be a need for a better single-wheel jack capable of being used easily and safely by the experienced tradesmen as well as by the hobby-time auto-mechanics.

SUMMARY OF THE INVENTION

In the present invention, however, there is provided a single-wheel jack that has a wheel tray that is inclinable in two directions, to facilitate the entry of a wheel therein when the jack is in a collapsed mode, and to positively retain a vehicle wheel when the jack is in a raised mode. The single-wheel jack of the present invention further has a latching mechanism to prevent unintentional lowering of the wheel tray.

Broadly, in accordance with a first feature of the present invention, there is provided a jack for raising a wheel of a vehicle and comprising a horizontal base having spaced-apart front end and entry end, spaced-apart side members extending between the front end and the entry end and longitudinal and transversal dimensions. A scissors-like lifting mechanism is connected to the horizontal base and has an upper end movable between a raised position at a distance above the horizontal base and a collapsed position against the horizontal base. A force-applying actuator is connected to the horizontal base and to the scissors-like lifting mechanism for actuating the scissors-like lifting mechanism. A wheel tray is connected to the upper end of the scissors-like lifting mechanism for up and down movements thereof between the raised position and the collapsed position. The wheel tray has spaced-apart front portion and entry portion, a bottom surface and a bumper on the front portion.

There is also provided a crossbar mounted in the scissors-like lifting mechanism for engaging with the wheel tray and for causing the entry portion of the wheel tray to lean down relative to the front portion when the upper end of the scissors-like lifting mechanism is in the collapsed position.

The scissors-like lifting mechanism has connections with the front and entry portions of the wheel tray and the connections with the front portion are differing in height and engagement sequence with the connections with the entry portion for causing the front portion of the wheel tray to lean down relative to the entry portion when the upper end of the scissors-like lifting mechanism is in the raised position.

The principal advantages of the jack of the present invention are that the wheel tray of the jack is inclinable to lean down toward the entry end of the horizontal base for facilitating a rolling of a vehicle wheel therein when the scissors-like lifting mechanism is in a collapsed position, and the wheel tray is inclinable to lean down toward the front end of the horizontal base, when the scissors-like lifting mechanism is in a raised position, for urging a vehicle wheel against the bumper of the wheel tray and for preventing the vehicle wheel from rolling out of the wheel tray.

According to another feature of the present invention, the scissors-like lifting mechanism has a pair of spaced-apart drive members and a pair of spaced-apart driven members joined at their midpoints by a pair of spaced-apart pivots defining a transversal articulation axis of the scissors-like lifting mechanism. The scissors-like lifting mechanism is actuated by an hydraulic cylinder connected to the base and to the spaced-apart drive members. When the scissors-like lifting mechanism is in a collapsed position, a longitudinal axis of the hydraulic cylinder is offset from the transversal articulation axis by a distance of at least ⅛ inch to 3/16 inch. This offset distance has been found to be advantageous for providing a substantial moment of force by the hydraulic cylinder on the scissors-like lifting mechanism for initiating a lift with ease.

In accordance with another feature of the present invention, there is provided a latching mechanism comprising a latch block affixed to the horizontal base and a loop member connected to one of the drive members for engagement with the latch block, when the scissors-like lifting mechanism is in the raised position. The scissors-like lifting mechanism is thereby lockable in the raised position for preventing accidental or unintentional lowering thereof.

In yet another feature of the present invention, the latching mechanism comprises a pair of wedge-like latch blocks respectively connected to one of the side members of the horizontal base and a pair of loop-shaped hook members respectively connected to one of the lower ends of the drive members. The loop-shaped hook members have inside dimensions for engagement with the wedge-like latch blocks as soon as the scissors-like lifting mechanism reaches a raised position.

The loop-shaped hook members are joined to one another by a round bar. A pair of cleft tabs are mounted on an actuator rod pivotally connected to the side members of the horizontal hollow base and extending parallel to and at proximity of the round bar when the hook members are engaged over the latch blocks, for engagement of the cleft tabs with the round bar. Each of these cleft tabs has a fork-like end for engagement thereof with the round bar and for selectively lifting the round bar and the loop-shaped hook members over the wedge-like anchor blocks. The actuator rod further has a handle connected thereto and disposed outside the horizontal hollow base. The scissors-like lifting mechanism is thereby releasable from a latch condition by actuating the handle on the actuator rod.

Still other features of the invention are that it is susceptible of a low cost of manufacture with regard to materials, equipment and labour, and which accordingly is then susceptible of low price of sale to the industry, thereby making such single-wheel jack economically available to the public.

BRIEF DESCRIPTION OF THE DRAWINGS

One embodiment of the present invention is illustrated in the accompanying drawings, in which like numerals denote like parts throughout the several views, and in which.

DETAILED DESCRIPTION OF THE PREFERRED EMBODIMENT

Figure 1:
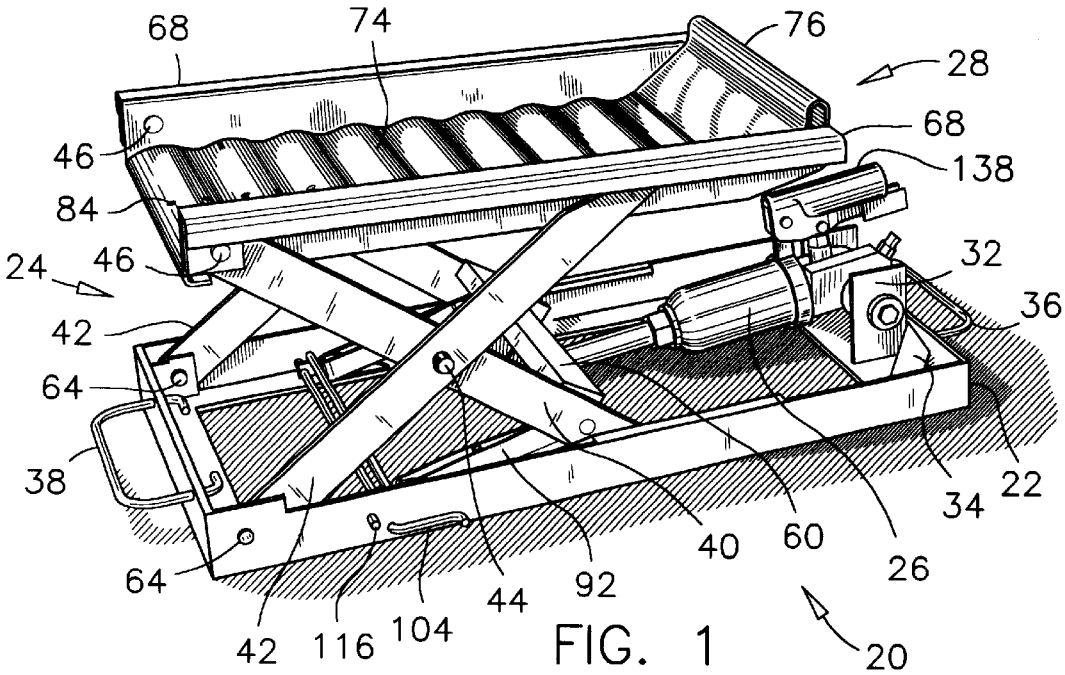
FIG. 1 is an entry end, right side and top perspective view of the single-wheel hydraulic jack according to the preferred embodiment of the present invention, shown with the wheel tray in a raised position.

While this invention is susceptible of embodiments in many various forms, there is shown in the drawings and will be described in details herein a specific embodiment, with the understanding that the present disclosure is to be considered as an example of the principles of the invention and is not intended to limit the invention to the embodiment illustrated.

The preferred embodiment of the present invention is a single-wheel hydraulic jack 20 usable for lifting a single wheel of a vehicle. The utility of this jack is well known to auto-mechanics, to body shop personnel and to all individuals who perform maintenance work on wheeled vehicles. This single-wheel hydraulic jack 20 is particularly advantageous for its low profile when it is in a collapsed mode, for its inclined wheel tray when fully raised, for its locking mechanism, and for several other features that are described herein below. The single-wheel hydraulic jack 20 according to the preferred embodiment is also referred to herein as the vehicle jack.

The vehicle jack 20, several features of which are illustrated in FIGS. 1–6, comprises broadly, an horizontal hollow base 22, a scissors-like lifting mechanism 24 mounted to the base, an hydraulic cylinder 26 connected to the base and to the scissors-like lifting mechanism for actuating the scissors-like lifting mechanism 24, and a wheel tray 28 mounted to the scissors-like lifting mechanism for receiving a wheel 30 to be raised.

Figure 4:
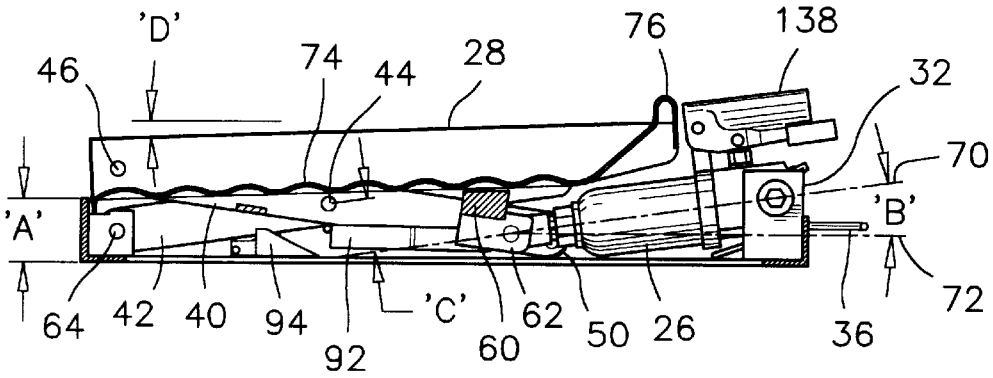
FIG. 4 is a partial longitudinal cross-section view of the single-wheel hydraulic jack as seen along line 4—4 in FIG. 2, but with the scissors-like lifting mechanism in a collapsed position.

The horizontal hollow base 22 is preferably rectangular in shape and made of angle iron having a thickness 'A' from the ground of about 1½ inches (38 mm) as shown in FIG. 4. The horizontal rectangular base 22 has a front end and an entry end, a longer side defining a longitudinal dimension and a shorter side defining a transversal dimension. The front end is the portion where the hydraulic cylinder 26 is mounted, and the entry end is the portion upon which a vehicle wheel rolls over to enter the wheel tray 28.

A pair of fixed devises 32 are affixed to the front end of the base 22 for rigidly supporting the pivot end of the hydraulic cylinder 26. There is also provided a pair of gusset members 34 affixed diagonally across each corner of the front end of the base for reinforcing that end of the base 22.

A first handle 36 is affixed to the front end of the base 22 for handling the vehicle jack 20 about a garage or under a vehicle. A second handle 38 is optionally affixed to the entry end of the base 22 to further facilitate the handling of the vehicle jack 20. This optional handle 38 is preferably a retractable one such that the vehicle jack 20 according to the preferred embodiment can be shipped or stowed in a form which is as compact as possible.

The scissors-like lifting mechanism 24 comprises a pair of drive members 40 set inside a pair of driven members 42 and connected to the driven members 42 by means of a pair of pivots 44 defining a first transversal articulation axis thereof passing through the midpoint of each of the members 40 and 42.

The drive members 40 have a respective first upper-driven end pivotally connected to the entry portion of the wheel tray 28 at pivots 46 on the wheel tray, and a respective lower drive end 48 having a lower roller 50 affixed thereto. The drive members 40 are mounted and extend astride the bottom surface of the wheel tray 28.

Each lower roller 50 is adapted to roll inside the angle iron of the horizontal base 22. Each lower roller 50 is preferably the type having a threaded stem extending along an axis thereof and being known in the industry as a track runner bearing.

There is also provided, and mounted across the drive members 40, a crossbar 60 which is visible in the perspective view in FIG. 1 and in the cross section view in FIG. 4. The crossbar 60 is connected to both drive members 40, near the driven ends of the drive members 40 and has a pair of driven devises 62 connected thereto for pivotally receiving the rod end of the hydraulic cylinder 26 and for transmitting the force of the hydraulic cylinder 26 to the drive members 40.

The driven members 42 have a respective lower reactive end pivotally connected to the entry end of the base 22 at pivots 64. The upper driven end of each driven members 42 has an upper roller 66 which is adapted to roll inside a channel-like rail member 68 formed in the wheel tray 28. Hence, when the drive members 40 are pushed by the hydraulic cylinder 26, the drive and driven members 40, 42 are pivoted about the transversal articulation axis 44 for lifting the wheel tray 28 in a manner which is common to scissors-type lifting mechanisms.

The longitudinal axis 70 of the hydraulic cylinder 26 is preferably set at an angle 'B' of one or few degrees down from a horizontal line 72 such that the force of the hydraulic cylinder 26 causes the lower rollers 50 to remain in contact with the angle iron of the base 22. The alignment of the axis 70 also contributes to providing a push-force moment about the transversal articulation axis 44 for initiating a lifting action. For this purpose, a minimum distance 'C' of about ⅛ to 3⁄16 inch (3–5 mm) is preferably maintained between the longitudinal axis 70 of the hydraulic cylinder 26 and the transversal articulation axis 44.

The wheel tray 28 is preferably manufactured with pressed metal sheet. A channel-like rail member 68 is preferably formed on each side of the wheel tray 28 for laterally enclosing a bottom surface of the wheel tray. The wheel tray 28 preferably has reinforcing corrugations 74 across its bottom surface for reinforcing the bottom surface. The wheel tray 28 further has a front bumper 76 across its front end.

Figure 5:
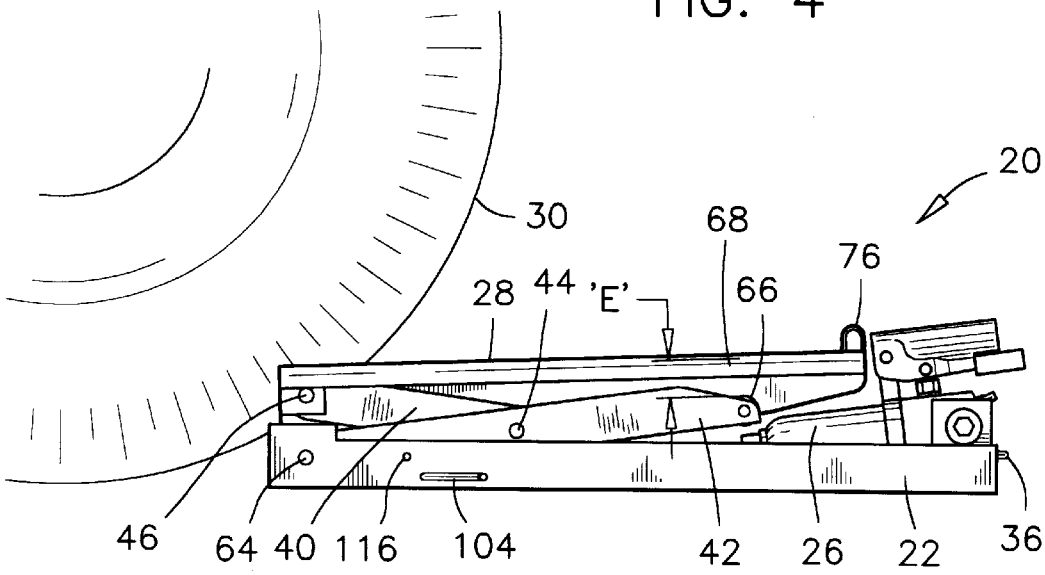
FIG. 5 is a side view of the single-wheel hydraulic jack, shown with the scissors-like lifting mechanism in the collapsed position, with a partial view of a wheel being driven in the wheel tray.
Figure 6:
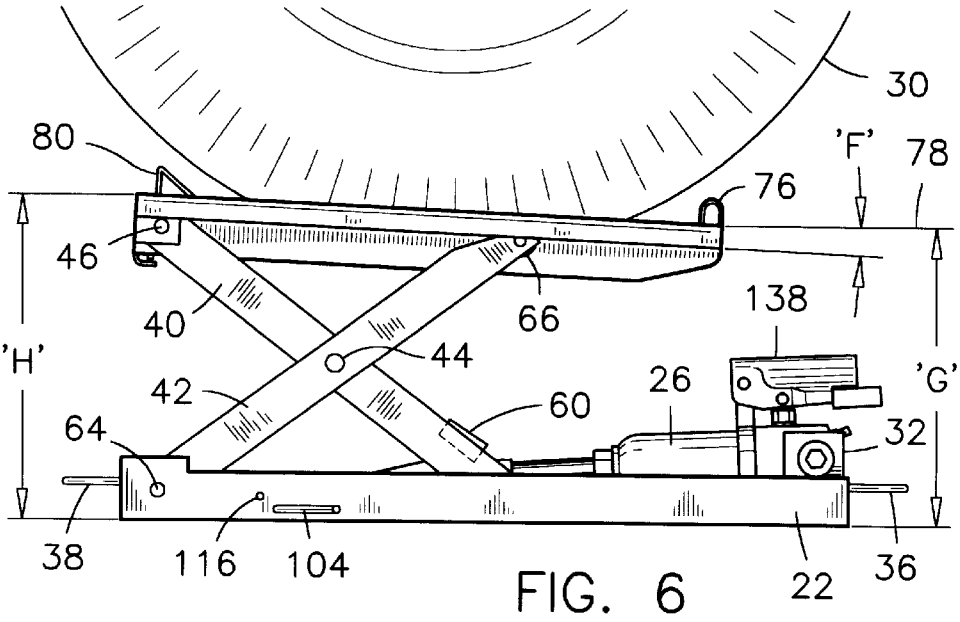
FIG. 6 is a side view of the single-wheel hydraulic jack shown with the scissors-like lifting mechanism in the raised position and a partial view of a wheel being supported in the wheel tray.
Figure 7:
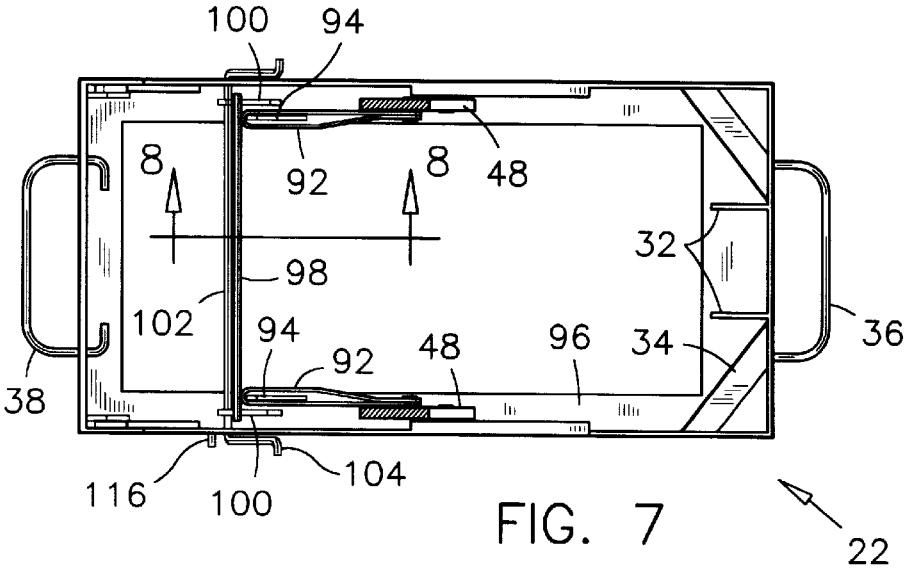
FIG. 7 illustrates a partial top view of the horizontal base of the single-wheel hydraulic jack according to the preferred embodiment.

Referring now particularly to FIGS. 4–6, there are illustrated therein some important features of the vehicle jack 20 according to the preferred embodiment. A first important feature is that when the vehicle jack 20 is fully collapsed, the bottom portion of the wheel tray 28 comes in contact with the crossbar 60 and is raised by the crossbar 60 as illustrated in FIG. 4. The crossbar 60 causes the wheel tray 28 to tilt about the pivots 46 an angle 'D' of one or few degrees from a horizontal plane, such that the front portion of the wheel tray remains above the hydraulic cylinder 26 and above the driven devises 62, and such that the entry portion of the wheel tray 28 is able to at least partly retract into the base 22. This feature is particularly appreciable for easily driving a wheel 30 into the wheel tray 28 without requiring a ramp or similar inclined structure at the entry end of the wheel tray 28, as illustrated in FIG. 5.

The tilting of the tray 28 as just described causes the front portion of the tray to be raised above the upper rollers 66 on the driven members 42 by a distance 'E' as also illustrated in FIG. 5. Therefore, when the hydraulic cylinder 26 is extended from a retracted position, the entry portion of the wheel tray 28 starts to rise first, and continues to be raised until the upper rollers 66 are up into the channel-like rail members 68, and in contact with the inside portion of the rail members 68.

The height of the crossbar 60 relative to the drive members 40 when these drive members are in the collapsed mode, the engagement sequence between the driven ends of the drive and driven members and the wheel tray, and the associated distance 'E' are preferably selected such that when the upper rollers 66 are in contact with the channel rail members 68, the wheel tray 28 is lightly inclined downward forwardly.

The thickness of the crossbar 60, the location of the pivots 46, the distance 'E' and the size of the upper rollers 66 are selected such that when the wheel tray 28 is in a raising mode and in a raised position, it is preferably inclined forwardly an angle 'F' of one or few degrees below an horizontal line 78, to urge the wheel 30 being raised against the front bumper 76.

The preferred inclination 'F' is a difference of about ½ inch (13 mm) between the height 'G' of the front portion, the front portion being lower, and the height 'H' of the entry portion. This feature is advantageous for preventing the wheel 30 from rolling off the vehicle jack 20 when the vehicle jack is in use.

Figure 11:
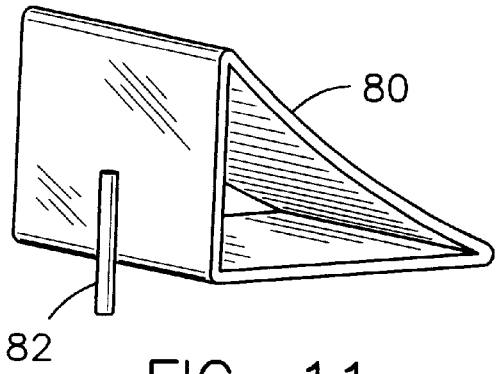
FIG. 11 is an entry end and right side perspective view of a wheel chock usable with the single-wheel hydraulic jack according to the preferred embodiment.

For additional safety, although this is optional, a wheel chock 80 having an anchor pin 82 thereon as illustrated in FIG. 11, may be installed in the wheel tray 28 as illustrated in FIG. 6, with the anchor pin 82 inserted into one of several holes 84 provided for this purpose in the bottom surface of the wheel tray 28.

Referring now to FIGS. 7–10, there is illustrated therein another important feature of the vehicle jack 20 according to the preferred embodiment. The vehicle jack 20 has a locking mechanism 90 for locking the scissors-like lifting mechanism 24 in a raised position. The locking mechanism 90 comprises a pair of elongated loop-shaped hook bars 92 respectively pivotally connected to the lower end 48 of a drive member 40. Each loop-shaped hook bar 92 is adapted to engage onto a wedge-like anchor block 94 affixed to the lower portion of the side member 96 of the horizontal base 22, when the drive members 40 reaches an uppermost position. Both loop-shaped hook bars 92 are connected to each other by a transversal round bar 98 such that they are movable together.

There is also provided, a pair of cleft tabs 100 rigidly mounted on an actuator rod 102 extending across the base 22. The actuator rod 102 extends along the transversal round bar 98 when the scissors-like lifting mechanism reaches a raised position. The actuator rod 102 extends through the angle iron of the base 22, and has one or two handle-like bent portions 104 extending outside the base 22.

Figure 8:
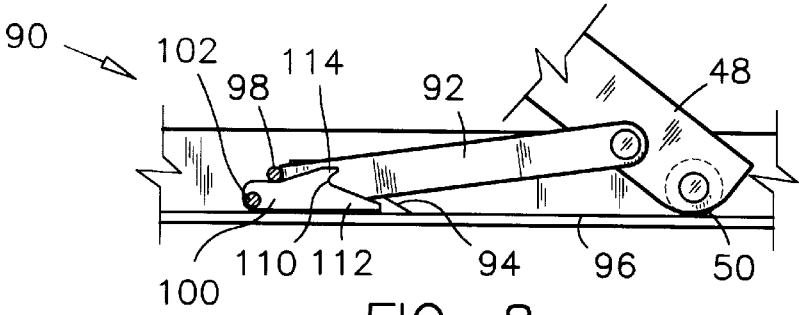
FIG. 8 is a first side view of the locking mechanism mounted inside the horizontal base of the single-wheel hydraulic jack and shown in a locked position.

When the scissors-like lifting mechanism 24 is actuated to raise the wheel tray 28, the loop-shaped hook bars 92 slide over the inclined surfaces 106 of both anchor blocks 94, and drop down at the entry end of the anchor blocks 94 to engage with the anchor blocks 94 as shown in FIG. 8, and to prevent any unintentional lowering of the jack 20. During this motion, the transversal round bar 98 slides over the cleft tabs 100, and rests above the cleft tabs 100 as illustrated in FIG. 8.

Figure 9:
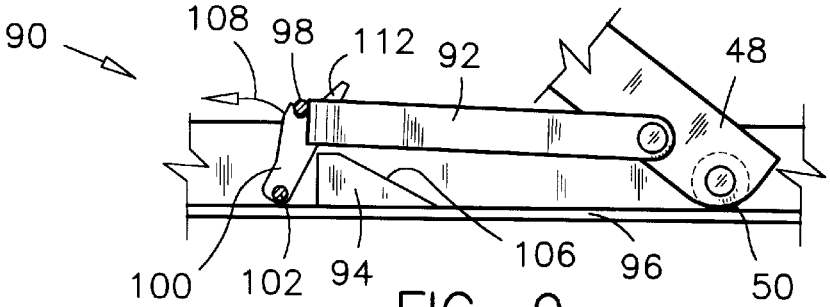
FIG. 9 is a second side view of the locking mechanism shown with the cleft tabs in an engaged and active mode.

The releasing of the locking mechanism 90 is effected by turning the bent portion 104 of the actuator rod 102, causing the cleft tabs 100 to lift the transversal round bar 98 and to cause the loop-shaped hook bars 92 to disengage from the anchor blocks 94. The turning of the cleft tabs 100 in a counterclockwise direction as indicated by arrow 108 in FIG. 9 also causes the transversal round bar 98 to engage into a hollow 110 in each cleft tab 100. Each hollow 110 is defined by a forward leg 112 and an entry side leg 114. The forward leg 112 is longer than an entry side leg 114 such that a turning of the tabs 100 in the counterclockwise direction 108 is partly limited by the engagement of the forward legs 112 against the transversal round bar 98, as illustrated in FIG. 9. The rotation of the cleft tabs 100 in a counterclockwise direction 108 is also limited by a stopper pin 116 protruding from the side of the base 22 and acting against the handle-like bent portion 104. The stopper pin 116 is illustrated in FIGS. 1 and 5–7.

Figure 10:
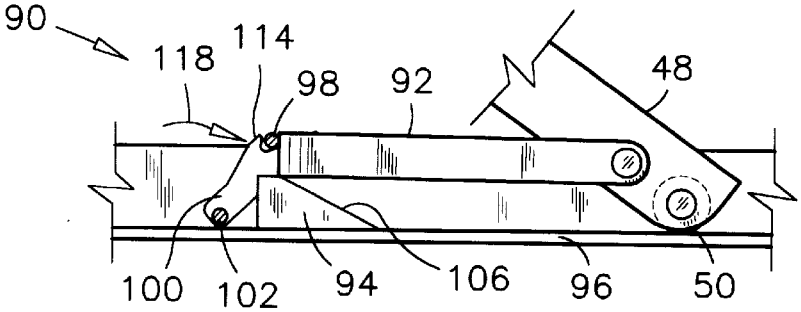
FIG. 10 is a third side view of the locking mechanism shown with the cleft tabs in an unlatching mode.

During the lowering of the vehicle jack 20 according to the preferred embodiment, the cleft tabs 100 retain the transversal round bar 98 and both loop-shaped hook bars 92 in a raised position above the anchor blocks 94. The lowering of the wheel tray 24 causes the cleft tabs 100 to rotate in a clockwise direction as indicated by arrow 118 and to release the transversal round bar 98 when the loop-shaped hook bars 92 are in a position to slide down over the inclined portion 106 of the anchor blocks 94, as illustrated in FIG. 10.

Figure 12:
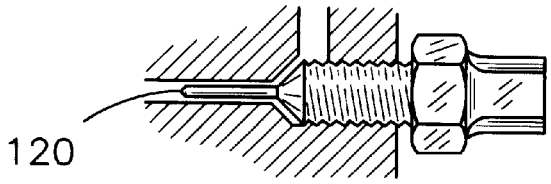
FIG. 12 is a partial cross-section of the hydraulic cylinder base showing a partial view of a flow control valve usable to regulate the lowering speed of the single-wheel hydraulic jack.

The lowering of the vehicle jack 20 according to the preferred embodiment is preferably effected in a smooth and controlled condition to avoid any sudden drop of the vehicle's wheel 30. Therefore, when a common hydraulic cylinder 26 is used to operate the scissors-like lifting mechanism, the release valve in this cylinder is preferably equipped with a flow regulator such as an elongated needle-type screw 120 in the oil return path of the valve, such as illustrated in FIG. 12, or any other flow control devices known in the industry.

Figure 2:
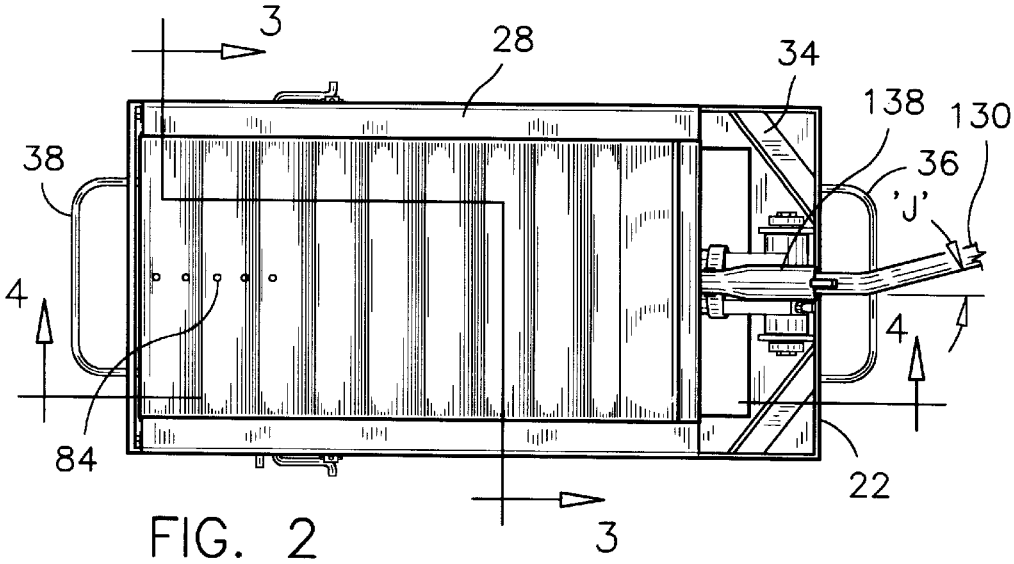
FIG. 2 is a top plan view of the single-wheel hydraulic jack shown with a partial view of the handle member usable for operating the hydraulic cylinder of the jack.
Figure 3:
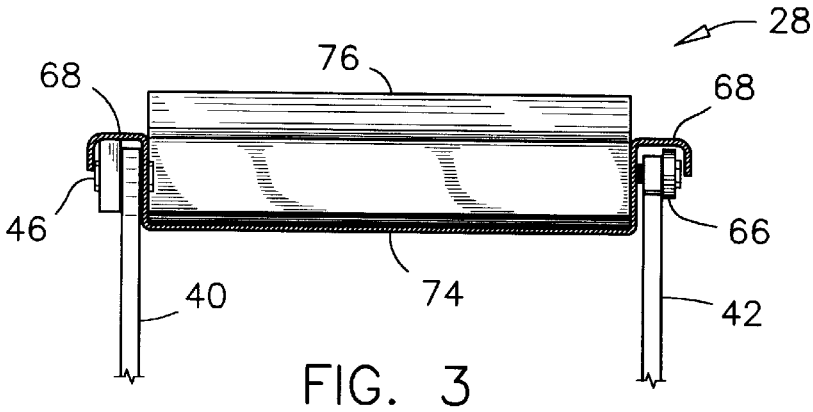
FIG. 3 is a partial transversal cross-section view of the wheel tray of the single-wheel hydraulic jack, as seen along line 3—3 in FIG. 2, but with the wheel tray in a raised position.
Figure 13:
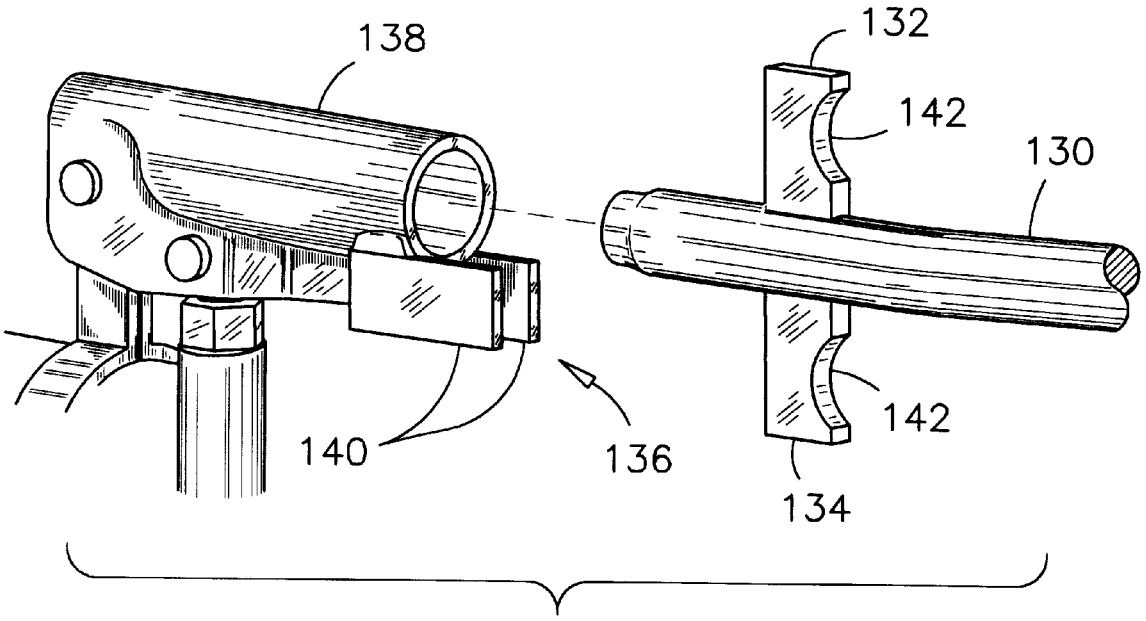
FIG. 13 is a front and right side partial perspective view of a socket and a handle used to operate the hydraulic cylinder on the single-wheel hydraulic jack according to the preferred embodiment.

Referring now to FIGS. 2 and 13, the pump-handle bar 130 used to actuate the hydraulic cylinder 26 is preferably bent sideway an angle 'J' of between about 5 degrees and about 45 degrees. This feature is preferred for preventing a rubbing of the handle bar 130 against a painted surface of a bumper or a fender of a vehicle for example when the vehicle jack 20 is used to raise a wheel of a vehicle.

It will be appreciated, however, that the vehicle jack 20 may be used under a driver or a passenger side of a vehicle and therefore, the handle bar 130 according to the preferred embodiment is reversible for use on either sides of a vehicle. For this purpose, the handle bar 130 has a pair of tabs 132, 134 extending in opposite directions from each other and from the socket-engaging end of the handle, and at right angle with a plane defined by the angle 'J'. Each tab is mountable into a slot 136 formed under the pump socket 138 of the hydraulic cylinder 26. The engagement of either tabs 132, 134 into the slot 136 prevents a rotation of the bar 130 when pumping the hydraulic jack 26 of the vehicle jack 20. The slot 136 is defined by a pair of spaced-apart and parallel plates 140, affixed to an underside of the pump socket 138. Therefore, the handle bar 130 is usable for examples, on a driver side of a vehicle with the tab 134 engaged into the slot 136, or on a passenger side of a vehicle with the tab 132 engaged into the slot 136.

Each of tabs 132, 134 preferably has a rounded notch 142 therein for optional engagement with the first handle 36 or with any part of the vehicle jack, for conveniently moving the vehicle jack 20 on a shop floor or from under a vehicle.

As to further manner of usage, further structural details and manufacturing of the vehicle jack according to the present invention, the same should be apparent from the above description and accompanying drawings, and accordingly, further discussion relative to these aspects would be considered repetitious and is not provided.

It will also be appreciated that while the above description provides a full and complete disclosure of the preferred embodiment of this invention, various modifications, alternate constructions and equivalents may be employed and various uses may be devised without departing from the true spirit and scope of the invention. Such changes might involve alternate components, structural arrangements, construction features or the like. Therefore, the above description and the illustrations should not be construed as limiting the scope of the invention which is defined by the appended claims.

What is claimed is:

1. A jack for raising a wheel of a vehicle, comprising:

a horizontal base having spaced-apart front end and entry end, spaced-apart side members extending between said entry end and said front end, and longitudinal and transversal dimensions;

a scissors-like lifting mechanism mounted to said horizontal base and having an upper end movable between a raised position at a distance above said horizontal base and a collapsed position near said horizontal base;

a force-applying actuator connected to said horizontal base and to said scissors-like lifting mechanism for actuating said scissors-like lifting mechanism;

a wheel tray connected to said upper end of said scissors-like lifting mechanism for up and down movement thereof between said raised position and said collapsed position; said wheel tray having spaced-apart front portion and entry portion, a bottom surface and a bumper on said front portion;

a means for lowering said entry portion of said wheel tray relative to said front portion, connected to said scissors-like lifting mechanism and to said wheel tray, for lowering said entry portion of said wheel tray relative to a position of said front portion when said upper end of said scissors-like lifting mechanism is in said collapsed position, said means for lowering said entry portion of said wheel tray relative to said front portion comprising a crossbar mounted in said scissors-like lifting mechanism and acting against said bottom surface of said wheel tray, and;

a means for lowering said front portion of said wheel tray relative to said entry portion, connected to said scissors-like lifting mechanism and to said wheel tray, for lowering said front portion of said wheel tray relative to a position of said entry portion when said upper end of said scissors-like lifting mechanism is in said raised position;

such that said wheel tray is inclinable downward toward said entry end of said horizontal base for facilitating a rolling of a vehicle wheel therein when said upper end of said scissors-like lifting mechanism is in said collapsed position, and such that said wheel tray is inclinable downward toward said front end of said horizontal base, for urging a vehicle wheel against said bumper for preventing said wheel from rolling out of said wheel tray when said upper end of said scissors-like lifting mechanism is in said raised position.

2. The jack as claimed in claim 1, wherein said means for lowering said entry portion of said wheel tray relative to said front portion comprises means for inclining said wheel tray one or few degrees downward toward said entry end of said horizontal base.

3. The jack as claimed in claim 2, wherein said means for lowering said front portion of said wheel tray relative to said entry portion comprises means for inclining said wheel tray one or few degrees downward toward said front end of said horizontal base.

4. A jack for raising a wheel of a vehicle, comprising:

a horizontal hollow base having spaced-apart front end and entry end, spaced-apart side members extending between said entry end and said front end, and longitudinal and transversal dimensions;

a scissors-like lifting mechanism mounted in said horizontal hollow base and having overall dimensions for allowing a partial retraction thereof into said horizontal hollow base; said scissors-like lifting mechanism having a pair of drive members, and a pair of driven members pivotally connected to said drive members and disposed outside said drive members; said scissors-like lifting mechanism having a raised position with said drive and driven members extending away from said horizontal hollow base and a collapsed position with said drive and driven members laid against said horizontal hollow base;

each of said drive members having a first elongated shape, a drive end and a first driven end opposite said drive end;

each of said driven members having a second elongated shape, a reactive end and a second driven end opposite said reactive end;

a wheel tray connected to said scissors-like lifting mechanism for up and down movement thereof by said scissors-like lifting mechanism above said horizontal hollow base; said wheel tray having spaced-apart front portion and entry portion, a bottom surface between said front portion and said entry portion and a pair of rail members laterally enclosing said bottom surface and extending above said bottom surface between said front portion and said entry portion;

an hydraulic cylinder connected to said front end of said horizontal hollow base and to said drive ends of said drive members for actuating said scissors-like lifting mechanism in up and down directions relative to said horizontal hollow base;

said drive ends of said drive members being movably engaged with said side members of said horizontal hollow base;

said first driven ends of said drive members being pivotally connected to said rail members, near said entry portion of said wheel tray;

said drive members extending astride said bottom surface of said wheel tray;

each of said reactive ends of said driven members being pivotally connected to said side members of said horizontal hollow base near said entry end;

each of said second driven ends of said driven members having an upper roller mounted thereon and being adapted to engage with one of said rail members near said front portion of said wheel tray for supporting said front portion of said wheel tray when said scissors-like lifting mechanism is in said raised position; and a crossbar mounted across said drive ends of said drive members and adapted to engage with said bottom surface of said wheel tray for supporting said bottom surface of said wheel tray when said scissors-like lifting mechanism is in said collapsed position;

such that when said scissors-like lifting mechanism is being lowered into said collapsed position, said crossbar is able to engage with said bottom surface of said wheel tray to cause said wheel tray to tilt about said first driven ends of said drive members, for raising said front portion of said wheel tray and for allowing said wheel tray to lean down toward said entry end of said horizontal hollow base, and for allowing said entry portion of said wheel tray to partly recede into said horizontal hollow base.

5. The jack as claimed in claim 4, wherein an engagement of said first driven ends of said drive members with said rail members of said wheel tray comprises means for inclining said front end of said wheel tray down relative to said entry end with said front end of said wheel tray being over a distance of ½ inch lower than said entry end of said wheel tray when said scissors-like lifting mechanism is in said raised position.

6. The jack as claimed in claim 5, further comprising a lower roller mounted on each of said drive ends and said drive members for allowing a rolling movement of said drive ends along said side members of said horizontal hollow base.

7. The jack as claimed in claim 4, wherein said horizontal hollow base has a height of about 1½ inches.

8. The jack as claimed in claim 4, wherein a downward inclination of said wheel tray toward said entry end when said scissors-like lifting mechanism is in said collapsed position is about one or few degrees.

9. The jack as claimed in claim 4, wherein said drive members are connected to said driven members along a common articulation axis, and a longitudinal axis of said hydraulic cylinder is offset from said common articulation axis by a distance of at least ⅛ inch to 3/16 inch, when said scissors-like lifting mechanism is in said collapsed position.

10. The jack as claimed in claim 4, wherein each of said rail members has a channel-like shape having an open side facing said scissors-like lifting mechanism for engagement with one of said upper rollers.

11. The jack as claimed in claim 4, wherein said bottom surface of said wheel tray is a corrugated surface.

12. The jack as claimed in claim 4, further comprising a locking mechanism connected to said drive members and to said horizontal hollow base for selectively retaining said scissors-like lifting mechanism in said raised position.

13. A jack for raising a wheel of a vehicle, comprising:

a horizontal hollow base having a front end, an entry end, spaced-apart side members extending between said entry end and said front end, and longitudinal and transversal dimensions;

a scissors-like lifting mechanism mounted in said horizontal hollow base and having a pair of drive members and a pair of driven members pivotally connected to said drive members along an articulation axis common to both said drive members and said driven members, said scissors-like lifting mechanism having a raised position with said drive and driven members extending away from said horizontal hollow base and a collapsed position with said drive and driven members laid against said horizontal hollow base;

each of said drive members having a drive end movably mounted to said horizontal hollow base and a first upper driven end extending away from said drive end;

each of said driven members having a reactive end connected to said entry end of said horizontal hollow base and a second upper driven end extending away from said reactive end;

a wheel tray supported on said first upper driven ends of said drive members and on said second upper driven ends of said driven members for up and down movement thereof by said scissors-like lifting mechanism above said horizontal hollow base;

an hydraulic cylinder connected to said front end of said horizontal hollow base and to said drive ends of said drive members for actuating said scissors-like lifting mechanism in up and down directions relative to said horizontal hollow base; and a latching mechanism comprising a pair of wedge-like latch blocks respectively connected to one of said side members of said horizontal hollow base and a pair of loop-shaped hook members respectively connected to one of said drive ends of said drive members, and each of said loop-shaped hook members having inside dimensions for engagement with one of said wedge-like latch blocks when said scissors-like lifting mechanism is in said raised position;

such that said scissors-like lifting mechanism is lockable in said raised position for preventing accidental or unintentional lowering thereof.

14. The jack as claimed in claim 13, wherein said loop-shaped hook members are joined to one another by a round bar.

15. The jack as claimed in claim 14, wherein said latching mechanism further comprises a pair of cleft tabs mounted on an actuator rod pivotally connected to said side members of said horizontal hollow base and extending parallel to said round bar at proximity of said round bar when said scissors-like lifting mechanism is in said raised position, for engagement of said cleft tabs with said round bar.

16. The jack as claimed in claim 15, wherein each of said cleft tabs has a fork-like end for engagement with said round bar and for selectively lifting said round bar and said loop-shaped hook members over said wedge-like anchor blocks.

17. The jack as claimed in claim 16, wherein said actuator rod has a portion thereof extending outside said horizontal hollow base and said portion is bent in a handle-like shape.

18. The jack as claimed in claim 13, wherein said scissors-like lifting mechanism further comprises a means for lowering said entry portion of said wheel tray relative to said front portion when said scissors-like lifting mechanism is in said collapsed position, and a means for lowering said front portion of said wheel tray relative to said entry portion when said scissors-like lifting mechanism is in said raised position.

19. The jack as claimed in claim 1, further comprising a latching mechanism comprising a pair of wedge-like latch blocks affixed to said horizontal base and a pair of loop-shaped hook members connected to said scissors-like lifting mechanism for engagement with said wedge-like latch blocks when said scissors-like lifting mechanism is in said raised position.

20. The jack as claimed in claim 13, wherein said wheel tray has a front portion and an entry portion, and further comprising means for lowering said entry portion of said wheel tray relative to said front portion, connected to said scissors-like lifting mechanism and to said wheel tray, for lowering said entry portion of said wheel tray relative to a position of said front portion when said upper end of said scissors-like lifting mechanism is in said collapsed position, and said means for lowering said entry portion of said wheel tray relative to said front portion comprises a crossbar mounted in said scissors-like lifting mechanism and acting against said bottom surface of said wheel tray.

* * * * *